US010648298B2

(12) United States Patent
Di Crescenzo et al.

(10) Patent No.: US 10,648,298 B2
(45) Date of Patent: May 12, 2020

(54) METHOD OF EXPANDING A TUBULAR AND EXPANDABLE TUBULAR

(71) Applicant: SHELL OIL COMPANY, Houston, TX (US)

(72) Inventors: Daniele Di Crescenzo, New Orleans, LA (US); Mark Michael Shuster, Voorburg (NL); Djurre Hans Zijsling, Rijswijk (NL); Rob Bosman, Enschede (NL)

(73) Assignee: SHELL OIL COMPANY, Houston, TX (US)

( * ) Notice: Subject to any disclaimer, the term of this patent is extended or adjusted under 35 U.S.C. 154(b) by 198 days.

(21) Appl. No.: 15/740,168

(22) PCT Filed: Jul. 1, 2016

(86) PCT No.: PCT/EP2016/065463
§ 371 (c)(1),
(2) Date: Dec. 27, 2017

(87) PCT Pub. No.: WO2017/001646
PCT Pub. Date: Jan. 5, 2017

(65) Prior Publication Data

US 2018/0187528 A1 Jul. 5, 2018

(30) Foreign Application Priority Data

Jul. 1, 2015 (EP) ..... 15174874

(51) Int. Cl.
*E21B 43/10* (2006.01)
*C10M 169/04* (2006.01)
*E21B 43/30* (2006.01)

(52) U.S. Cl.
CPC ..... *E21B 43/106* (2013.01); *C10M 169/04* (2013.01); *E21B 43/103* (2013.01);
(Continued)

(58) Field of Classification Search
CPC .... E21B 43/103; E21B 43/105; E21B 43/106; E21B 43/108
See application file for complete search history.

(56) References Cited

U.S. PATENT DOCUMENTS 5,294,309 A * 3/1994 Seimiya ..... B23H 5/08 205/660
6,557,640 B1 5/2003 Cook et al.
(Continued)

FOREIGN PATENT DOCUMENTS

EP 2210931 A1 7/2010
WO 0126860 A1 4/2001
(Continued)

OTHER PUBLICATIONS

KG Industries, KG Gear Kote Dry Film Lubricant Technical Data Sheet, Jul. 2, 2008, Revision C, 4 pages (Year: 2008).*
(Continued)

*Primary Examiner* — Jennifer H Gay

(57) ABSTRACT

A tubular member (1) with a relative rough (1.5-10 μm) inner surface (5) coated solid lubricating film (10) which is transformed into a substantially viscous rubbery viscoelastoplastic phase at temperatures in a range between 50° C. and 110° C. is expanded by moving an expansion member (24) with a relatively smooth outer surface (roughness<1.5 μm) therethrough, such that during expansion a viscous viscoelastoplastic substantially rubbery lubricating film (44) is generated between the tubular member (1) and the expansion mandrel (24), which film remains bonded to the rough inner surface (5) of the expanded tubular (1), but does not stick to the relatively hot and smooth expansion member (24).

14 Claims, 2 Drawing Sheets

(52) U.S. Cl.
CPC ..... *E21B 43/105* (2013.01); *E21B 43/108* (2013.01); *E21B 43/30* (2013.01); *C10M 2205/14* (2013.01); *C10M 2207/126* (2013.01); *C10N 2230/12* (2013.01); *C10N 2250/121* (2013.01); *C10N 2280/00* (2013.01)

(56) References Cited

U.S. PATENT DOCUMENTS 6,695,012 B1 * 2/2004 Ring ..... B21D 39/04 138/98
7,571,774 B2 * 8/2009 Shuster ..... E21B 43/105 166/206
8,420,581 B2 * 4/2013 Goto ..... C10M 169/04 508/154
10,308,892 B2 * 6/2019 Petlyuk ..... C10M 105/04
2003/0111838 A1 * 6/2003 Goto ..... C10M 111/04 285/94
2005/0123639 A1 * 6/2005 Ring ..... B21D 39/04 425/392
2005/0269107 A1 * 12/2005 Cook ..... E21B 43/103 166/384
2006/0127622 A1 * 6/2006 Mohan ..... F16L 55/1656 428/36.91
2006/0219414 A1 * 10/2006 Shuster ..... E21B 43/103 166/384
2007/0131431 A1 * 6/2007 Shuster ..... E21B 43/105 166/380
2007/0205001 A1 * 9/2007 Shuster ..... B21D 39/04 166/380
2010/0038076 A1 * 2/2010 Spray ..... E21B 17/00 166/207
2010/0264649 A1 * 10/2010 Goto ..... C10M 169/04 285/333
2011/0285124 A1 11/2011 Pinel et al.
2014/0187666 A1 * 7/2014 Aizenberg ..... A61L 33/0094 523/113
2015/0132539 A1 * 5/2015 Bailey ..... C23C 28/042 428/141
2016/0032695 A1 * 2/2016 Luke ..... E21B 34/066 166/285
2016/0040494 A1 * 2/2016 Besijn ..... E21B 43/105 166/285
2016/0145532 A1 * 5/2016 Petlyuk ..... C10M 105/04 72/42
2018/0148599 A1 * 5/2018 Bandyopadhyay ..... B05D 3/06
2018/0187528 A1 * 7/2018 Di Crescenzo ..... E21B 43/103
2018/0274703 A1 * 9/2018 Goto ..... C09D 7/40

FOREIGN PATENT DOCUMENTS

WO 0133037 A1 5/2001
WO 2007042231 A2 4/2007
WO 2012104257 A1 8/2012
WO 2014154582 A1 10/2014
WO 2015005978 A1 1/2015

OTHER PUBLICATIONS

Di Crescenzo et al., "Lubricants and Accelerated Test Methods for Expandable Tubular Application", Society of Petroleum Engineers, 2015, SPE-173111-MS, 10 pages.
International Search Report and Written Opinion received for PCT Patent Application No. PCT/EP2016/065463, dated Sep. 26, 2016, 10 pages.
"Grease (lubricant)", Wikipedia, the free encyclopedia, retrieved from Internet : "https://en.wikipedia.org/wiki/Grease_(lubricant)" on Jan. 3, 2018, 6 pages.

* cited by examiner

METHOD OF EXPANDING A TUBULAR AND EXPANDABLE TUBULAR

CROSS REFERENCE TO EARLIER APPLICATIONS

This is a National phase application of International Application PCT/EP2016/065463, filed 1 Jul. 2016, which claims priority of European application 15174874.6, filed 1 Jul. 2015.

FIELD OF THE INVENTION

The present invention relates to a method of expanding a tubular member, and to an expandable well tubular.

BACKGROUND OF THE INVENTION

Wellbores for the production of hydrocarbon fluid are typically provided with steel casings and/or liners to provide stability to the wellbore wall and to prevent undesired flow of fluid between the wellbore and the surrounding earth formation. A casing typically extends from surface into the wellbore, whereas a liner may extend only in a lower portion of the wellbore. However in the present description the terms "casing" and "liner" are used interchangeably and without such intended difference.

In a conventional wellbore, the wellbore is drilled in sections whereby each section is drilled using a drill string that has to be lowered into the wellbore through a previously installed casing section. In view thereof the wellbore and the subsequent casing sections decrease in diameter with depth. The production zone of the wellbore therefore has a relatively small diameter in comparison to the upper portion of the wellbore. In view thereof it has been proposed to drill a "mono diameter" wellbore whereby the casing or liner to be installed is radially expanded in the wellbore after lowering to the required depth. Subsequent wellbore sections therefore may be drilled at a diameter larger than in the conventional wellbore. If subsequent casing sections are expanded to the same diameter as the previous section, the wellbore diameter may remain substantially constant with depth for several sections.

A tubular member such as a section of casing or liner can be expanded by forcing an expansion member, such as an expansion cone or expansion mandrel through the passage of the tubular member, by mechanical and/or hydraulic pulling and/or pushing forces.

The expansion member engages at least part of the inner surface of the tubular member, and the sliding action against the pipe produces a friction force at the interface between the engaging surface area of the cone and the contact part of the inner surface of the tubular member. Lubrication of the interface is required, and various lubrication methods have been proposed.

U.S. Pat. No. 9,422,794 discloses a system for lining a wellbore. In this known method a well tubular is expanded by moving an expansion cone therethrough. The expansion cone is connected to a drill string that is pulled up, whilst the upper end of the tubular is maintained in a fixed position within an previously installed well tubular by a radially expanded top anchor assembly. The well tubular was internally lubricated with Malleus STC1 lubricant prior to expansion.

U.S. Pat. No. 6,557,640 discloses a method of lubricating an interface between a tubular member and an expansion cone, wherein a lubricating fluid is injected through at least a portion of the expansion cone into the trailing edge portion of the interface between the expansion mandrel and a tubular member during the radial expansion of the tubular member.

U.S. Pat. No. 6,695,012 discloses various lubrication systems and methods for expandable tubulars. In some embodiments, a layer of lubricant is coupled to the interior surface of a tubular member. In another embodiment, the interior surface is coupled with a first part of a lubricant, and a second part of the lubricant is circulated as part of a fluidic material during the expansion of the tubular member. Moreover, a number of suitable coatings for tubulars and coating components are disclosed, incorporated herein by reference.

Other known lubricating coatings are disclosed in US patent applications US2011/0285124 and US 2016/145532.

Experience with commercially available lubricating coatings has indicated that they have shortcomings that may result in poor or lack of lubrication, which may lead to field failure with catastrophic consequences such as: stick slick phenomena, galling, overpull or expansion pressure increase, pipe rupture and eventually stuck expansion cones and/or other well equipment. These conditions can lead to sidetracking and, in the worst case scenario, losing the well.

There is a need for an improved method and apparatus that provides more reliable lubrication during expansion of an expandable tubular.

SUMMARY OF THE INVENTION

In accordance with one aspect of the invention there is provided a method of expanding a tubular member, comprising

- providing a tubular member, having a longitudinal passage and having an inner surface;
- treating a contact part of the inner surface to increase the surface roughness from a first surface roughness to a second surface roughness, which second surface roughness is between 1.5 and 10 μm;
- providing the contact part of the inner surface with a lubricating layer, which is in a viscoelastoplastic phase in at least a substantial part of a temperature range between 50° C. and 110° C., in a substantially solid phase at temperatures below this range and in a substantially liquid phase at temperatures above this range; and
- expanding the tubular member by moving an expansion member having a surface roughness below 1.5 μm along the passage thereby engaging the contact area.

In another aspect the invention provides an expandable tubular having a longitudinal passage and having an inner surface, wherein a contact part of the inner surface has a surface roughness is in the range of from 1.5 μm to 10 μm, and wherein the contact part of the inner surface is covered by a lubricating coating, which is configured to be in a viscoelastoplastic, substantially viscous rubbery, phase in at least a substantial part of a temperature range between 50° C. and 110° C., in a substantially solid phase at temperatures below this range and in a substantially liquid phase at temperatures above this range.

BRIEF DESCRIPTION OF THE DRAWINGS

The invention will now be further described by way of example and with reference to the drawings, wherein FIG. 1A schematically shows a cross-section through a wall of an expandable tubular having a first surface roughness.

Like reference numerals are used in the Figures to refer to the same or similar objects.

DETAILED DESCRIPTION OF THE INVENTION

Figure 1A:
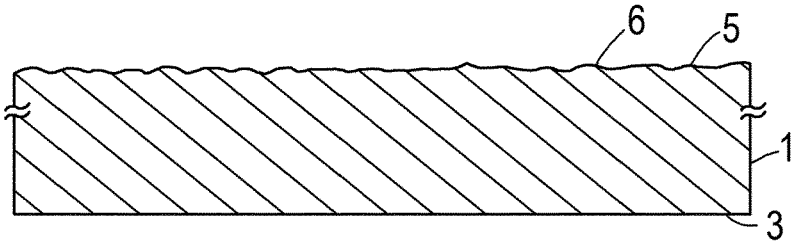
FIG. 1B schematically shows a cross-section through a wall of an expandable tubular having a second surface roughness.
FIG. 1C schematically shows a cross-section through a wall of an expandable tubular having a second surface roughness and being provided with a lubricating layer.
FIG. 1D schematically shows a cross-section through a wall of an expandable tubular during expansion.

Although the invention is not limited to any scientific theory it is believed that there is a synergetic interaction between the relatively high and low surface roughnesses of the expanded tubular and expansion member and the viscoelastoplastic behaviour of the lubricating coating in at least a substantial part of a temperature range between 500 C and 1100 C that results in mitigation of inadvertent or premature scraping off the lubricating coating by the expansion mandrel and preservation of a viscous viscoelastoplastic substantially rubbery lubricating film along at least a substantial part of the length of the expansion member, which film remains due to its viscoelastic properties bonded to the relatively rough inner surface of the expanded tubular, but does not stick to the relatively hot expansion member.

By a limited increased of the surface roughness, a larger reservoir of lubricant can be provided directly at the interface where contact forces apply during expansion while such limited increase in surface roughness does not substantially hamper the plastic deformation by an expansion member.

In some embodiments, the lubricating layer is a corrosion inhibiting layer. Metal tubulars such as steel tubulars are typically provided with a corrosion inhibiting coating shortly after production, so as to prevent e.g. rust formation during storage until use. When the layer contains both lubricating and corrosion inhibiting components, it is not needed to remove the corrosion inhibiting coating before applying the lubricating layer.

In some embodiments, the lubricating layer comprises one or more solid or thixotropic components selected from molybdenum di-sulfide, polytetrafluorethylene, graphite, sodium compounds, calcium compounds, zinc compounds, manganese compounds, and/or fatty acid derivatives.

In some embodiments the step of providing the lubricating layer comprises one of spraying or dipping in a liquid coating composition, followed by drying.

In some embodiments, the second surface roughness is suitably in the range of from 2 μm to 6 μm, and preferably in the range of from 2.5 μm to 5 μm.

In some embodiments the first surface roughness can be less than 2 μm, in particular less than 1.5 μm, more in particular less than 1 μm.

In some embodiments the step of treating a contact part of the inner surface to increase the surface roughness from a first surface roughness to a second surface roughness comprises blasting the contact part with particles.

In some embodiments the lubricating layer extends into the surface region defined by the second surface roughness, and wherein the second surface roughness is reduced to a third surface roughness during the step of expanding the tubular member.

This has the advantage that during expansion of the tubular, part of the lubricant that was contained in the region defined by the second surface roughness (such as by the envelope defined by the peaks of the surface) is made available for lubrication.

The expansion member is preferably cone-shaped. Optionally the cone-shaped expansion member is expandable from a first cross-section to a second, larger, cross section.

In some embodiments, the expansion member has an engaging surface area, which engages, during the step of expanding the tubular member, the contact part of the inner surface of the tubular member, and wherein the engaging surface area has a surface roughness of 0.5 μm or less, preferably of 0.1 μm or less. A smooth surface of the expansion member helps to minimize the forces required for plastic deformation of the asperities due to surface roughness of the inner tubular, and for macroscopic deformation due to transverse expansion of the tubular.

In some embodiments the surface roughness is in the range of from 2 μm to 6 μm, optionally of from 2.5 μm to 5 μm.

In some embodiments the expandable tubular is one of a length of well casing, well lining, or well tubing. The length can be at least 10 m, or at least 100 m, in some cases up to 1000 m or more.

In some embodiments the expandable tubular comprises a metal body, suitably a steel body, such as a carbon or martensitic steel body.

Reference is made to FIG. 1A, showing a cross-section through a wall of a well casing element 1, which is a tubular member that can be expanded. The well casing element 1 has an outer surface 3 and an inner surface 5. The well casing element in this example is made from martensitic steel. Suitable steel grades for well casings or other expandable well tubulars can for example be obtained from Vallourec (for example grade VM50). Another example of a suitable steel grade is S355J2H. The thickness of the expandable tubular 1 between the outer surface 3 and the inner surface 5 can for example be in the range of from 10 mm to 25 mm, in particular from 12.5 mm to 20 mm. The invention is particularly suitable for use with relatively thick tubulars, since expansion forces are relatively high (for example between 700 and 2000 kN), leading to a peak contact stress of exceeding 100 MPa, even exceeding 140 MPa for single pipe expansion and exceeding 300 MPa or even 400 MPa in the expansion of an overlap section of pipes where two pipe walls are being deformed and require particularly reliable lubrication. The contact stress can for example be between 100 and 500 MPa.

The inner surface 6 has a first surface roughness 6. Wherever reference is made in the description or the claims to the term "surface roughness", this refers to the arithmetical mean height of the surface, commonly referred to by the symbol $S_a$, and as defined by ISO 25178.

The first surface roughness is typically less than 2 μm, in particular less than 1.5 μm, more in particular less than 1 μm. The first surface roughness can be 0.001 μm or more, in particular 0.01 μm or more, such as 0.1 μm or more.

Figure 1B:
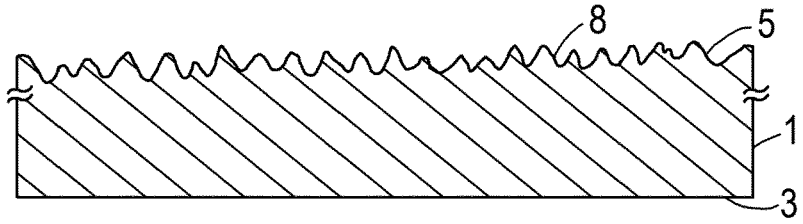

Reference is made to FIG. 1B, in which at least part of the inner surface 5 of well casing element 1 as described in FIG. 1A has been treated by particle blasting with aluminium oxide particles of ca 40-60 μm size to have a higher surface roughness 8.

The second surface roughness is less than 10 μm, for example less than 8 μm, and is suitably at least 1 μm, in particular at least 2 μm, in particular less than 6 μm, and can suitably be in the range of from 2 μm to 6 μm, and in particular in the range of from 2.5 μm to 5 μm. Good results have been obtained for surface roughnesses ranging from Sa=2.8-4.0 μm. Too low surface roughness of the inner surface diminishes the amount of lubricant that can be released when the surface roughness decreases during expansion. At higher surface roughness, plastic deformation by the expansion member becomes more difficult.

In some embodiments the expansion member will, during the expansion process, engage substantially the entire inner surface of the expandable tubular, and thus substantially the entire inner surface is a contact area that is suitably treated in accordance with the invention. In some embodiments however, the geometry of the expansion member or of the tubular member may be such that the contact area is smaller than the entire inner surface, and it is only necessary to treat the contact area, while optionally also substantially the entire inner surface area may be treated.

Figure 1C:
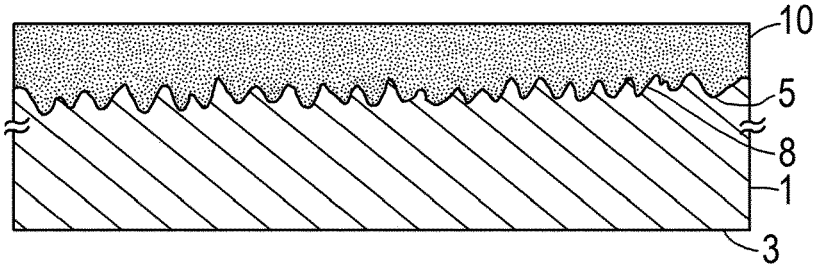

Reference is made to FIG. 1C, in which a lubricating layer 10 is provided on top of the inner surface 5 having the second surface roughness 8, as described in FIG. 1B. The lubricating layer near the inner surface 5 extends into and preferably fills the region 11 of micro-asperities and small dents defined by the envelope of the peak heights due to the second surface roughness 8.

Particularly suitable deposition methods for the lubricating layer are spraying or dipping in a liquid coating composition, followed by drying. The liquid coating composition can comprise a solvent or solvent mixture that evaporates at ambient, or elevated temperatures, preferably within 48 hours, to form a solid coating on the inner surface of the tubular. In some embodiments a heat treatment at elevated temperatures, such as at 60-100 degrees C., or at 100-140 degrees C., or at 140-200 degrees C., is employed. Heat treatment can speeds up evaporation of the solvent and optionally allows a chemical curing reaction to take place. Spraying or dipping is suitably conducted such that a sufficient thick film/coating is deposited on the inner surface so as to fill up the space defined by the surface roughness and deposit an additional lubricating layer on top. The lubricating layer after solvent evaporation and optional curing is suitably thicker than the surface roughness, preferably at least 5 times thicker, such as at least 30 μm, or at least 50 μm, or in some embodiments at least 10 times thicker such as at least 0.1 mm, and can also be at least 0.2 mm. A suitable maximum thickness of the layer is for example 0.5 mm, or 1 mm. This way excess lubricant is made available in the expansion system to accommodate any imperfections encountered in the expansion process. Parameters such as the concentration of solid components and the viscosity of the liquid can be determined such that a liquid layer is initially deposited that results in a solid or non-flowing lubricating layer of desired thickness. Spraying has the advantage that the liquid coating composition is more controlled with respect to the location of deposition and the amount.

The lubricating layer preferably comprises a mixture of a PolyEthylene(PE) wax and a stearate that is configured to be in a viscoelastoplastic, substantially viscous rubbery, phase in at least a major part of the temperature a range between 50° C. and 110° C. and to form a substantially solid coating at temperatures below this range. The stearate may be a calcium or sodium stearate which is configured to be hydrated in an aqueous environment at temperatures within the range and the lubricating layer further comprises radicals and a corrosion inhibiting agent.

The lubricating layer may furthermore comprise one or more solid or thixotropic components selected from molybdenum di-sulfide, polytetrafluorethylene, graphite, copper, and/or sodium compounds, calcium compounds, zinc compounds, manganese compounds, metallic soaps. Suitable sodium and calcium compounds are for example stearates. Suitable manganese compounds are for example phosphates. Suitable zinc compounds are for example phosphates or stearates. Suitable metallic soaps are for example calcium soap or grease, or lithium soap or grease. Examples of suitable lubricating layers are disclosed in the paper "SPE paper SPE/IADC-173111-MS, 2015, "Lubricants and Accelerated Test Methods for Expandable Tubular Application", incorporated herein by reference, or in the Wikipedia (English) article "Grease (lubricant)" as per the priority date of this application.

An example of a commercial solid film lubricant is 3000 Gear Kote marketed by KG Industries LLC, wherein the primary solid used for lubrication is molybdenum disulfide. Another example is LC-300 marketed by Sandstrom Products Company, which is dry film lubricant coating containing molybdenum, and which is normally heat cured at ca. 150 degrees C. Another suitable dry film lubricant is DFL 9085 from Brighton Laboratories, Inc. Other suitable compositions can be obtained from Houghton International Inc and are described in US patent application 2016/145532 of Houghton Technical Corporation.

Suitably the lubricating layer is able to withstand elevated temperatures, us as 120 degrees C. or more, or even 150 degrees C. or more, such as 180 degrees C. or more without a substantial degradation of lubricating properties.

In a preferred embodiment, the lubricating layer is a corrosion inhibiting layer. Metal tubulars such as steel tubulars are typically provided with a corrosion inhibiting coating shortly after production, so as to prevent e.g. rust formation during storage until use. When the layer contains both lubricating and corrosion inhibiting components, it is not needed to remove the corrosion inhibiting coating before applying the lubricating layer.

In some embodiments, the lubricating layer can be prepared from a liquid coating composition that comprises a liquid corrosion inhibiting composition and lubricating additives, by spraying or dipping followed drying as discussed hereinabove. A suitable liquid corrosion inhibiting composition is STOP CORROSION™ Lacquer Rust inhibitor and anti-corrosive coating, marketed by Aster Bellow Manufacturing Company, to which lubricating additives may be added. Other suitable liquid corrosion inhibiting compositions can be obtained from Houghton International Inc. under trade names Rust-Vento or Ensis.

Figure 2C:
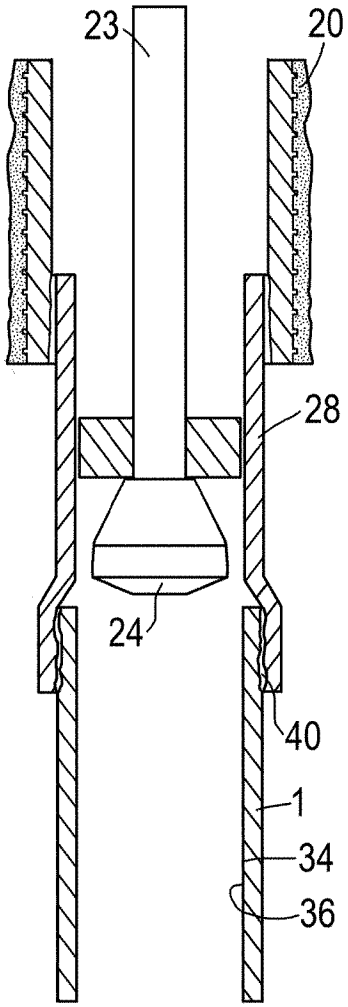
FIG. 2A-2C schematically show various stages of a process of expanding a tubular.
Figure 2B:
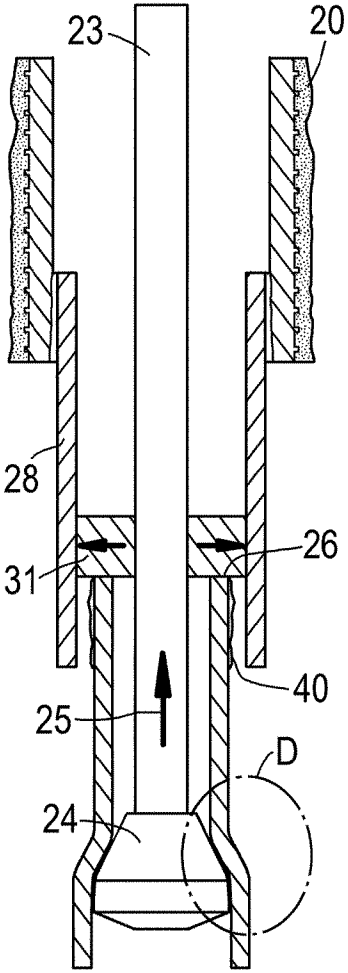
Figure 2A:
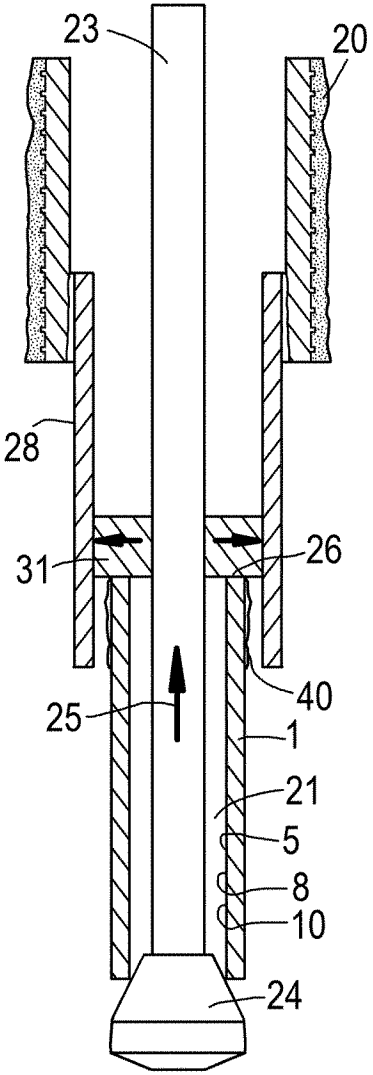

Reference is made to FIG. 2A, in which a well casing element 1 is shown prior to expansion in a wellbore (20). The substantially cylindrical inner surface of well casing element 1 has been provided with a lubricating layer 10 on top of a surface with surface roughness less than 10 μm, for example as described with reference to FIG. 1C.

Figure 1D:
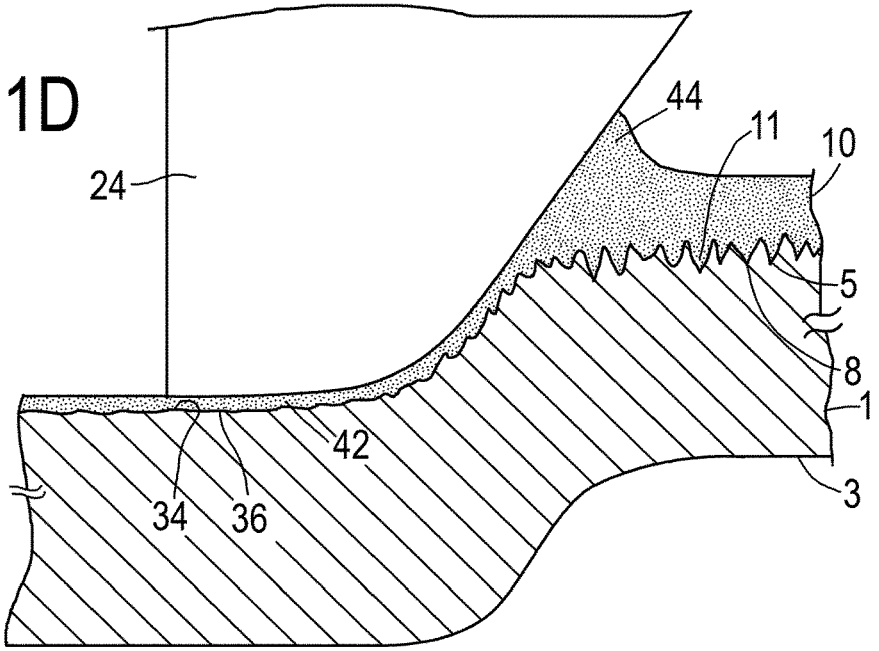

Reference is made to FIGS. 2B and 1D, wherein FIG. 1D is a magnification of area D in FIG. 2B.

The lower well tubular 1 is expanded by moving an expansion member 23 along the passage 21. The expansion member has a cross-section and shape that exerts transverse outward force onto a contact area on the inner surface of the tubular to be expanded. The expansion member in this example is an expansion cone 23 and is connected to a drill string 24. During expansion operation in this example, the drill string that is pulled up axially as illustrated by arrow 25, whilst the upper end 26 of the lower tubular is maintained in a fixed position within an upper well tubular 28 by a radially expanded top anchor assembly 31.

During expansion of the well tubular 1 is transversally (in this example effectively radially) plastically deformed by the cone, having larger cross-section than the cross-section of the passage 21, engaging the well tubular 1 with high contact force, e.g. 100-500 MPa, and with a speed of e.g. 3-10 m/min. Lubrication for smooth sliding of the cone is provided by the lubrication layer 10. Suitably, lubrication properties of the layer 10 are selected such that the static coefficient and the kinetic (also referred to as dynamic) coefficient of friction are both in the range of from 0.04 to 0.1. The static and kinetic coefficients of friction can be measured as per ASTM D1894.

In addition to the macroscopic plastic deformation of the wall of the tubular 1, the micro-asperities at the tubular surface can be plastically deformed and smoothened, so that a lower surface roughness 34 results in those areas 36 of the inner surface 5 that have been in contact with the cone 24 during expansion. Applicant has realized that both phenomena cause the volume of the small dents in the surface of the tubular to be reduced. Consequently the lubricant that was previously contained in these small dents or micro-asperities 11 is squeezed out of these pockets and made available for lubrication, in a thin layer 42, at the very location at the contact interface of the tubular member and the expansion member where contact forces apply. The additional reservoir or buffer of lubricant due to the increased surface roughness helps to prevent unlubricated metal-metal contact. Excess lubricant is pushed forward as indicated in region 44.

The third surface roughness of the metal surface underlying a remaining very thin lubricating layer is typically 1.5 μm or less, in particular 1 μm or less. The third surface can be 0.001 μm or more, in particular 0.01 μm or more, such as 0.1 μm or more, and can for example be in a range of from 0.01 to 1.5 μm, from 0.2 μm to 1 μm, or from 0.3-0.9 μm. The expansion member (cone) is suitably made from a very hard material, suitably having a Rockwell C hardness (cone) of $R_C$=60 or more. The expansion member suitably has a smooth surface with a surface roughness of 0.5 μm or less, preferably of 0.1 μm or less. Optionally the cone-shaped expansion member is expandable from a first cross-section to a second, larger, cross section. Such expandable cone can for example be run through a casing or liner string, and expanded in cross-section only below the tubular (such as well casing element 1) that is to be expanded using the cone.

When the expansion cone 24 reaches the top anchor assembly 31 in this particular embodiment, the top anchor assembly 31 needs to be retracted and pulled up by the expansion cone as illustrated in FIGS. 2B and 2C. In this embodiment the upper well tubular 28 overlaps in region 40 the lower well tubular 1, and particularly high expansion forces and good lubrication are needed in the overlap region. In some embodiments it may be chosen to apply the surface roughness and coating according to the invention only in this overlap region.

The present invention is not limited to the above-described embodiments thereof, wherein various modifications are conceivable within the scope of the appended claims. For instance, features of respective embodiments may be combined.

The invention claimed is:

1. A method of expanding a tubular member, comprising:

providing a tubular member, having a longitudinal passage and having an inner surface;

treating a contact part of the inner surface to increase the surface roughness from a first surface roughness to a second surface roughness, which second surface roughness is between 1.5 and 10 μm;

providing the contact part of the inner surface with a lubricating layer, which is in a viscoelastoplastic phase in at least a part of a temperature range between 50° C. and 110° C.; and expanding the tubular member by moving an expansion member having a surface roughness less than or equal to 1.5 μm and greater than zero μm along the passage thereby engaging the contact area, wherein the second surface roughness is reduced to a third surface roughness during expanding of the tubular member.

2. The method according to claim 1, wherein the lubricating layer comprises a mixture of a PolyEthylene (PE) wax and a stearate that is configured to be in a viscoelastoplastic, substantially viscous rubbery, phase in at least a major part of the temperature a range between 50° C. and 110° C. and to form a substantially solid coating at temperatures below this range.

3. The method according to claim 2, wherein the stearate is a calcium or sodium stearate which is configured to be hydrated in an aqueous environment at temperatures within the range and the lubricating layer further comprises radicals and a corrosion inhibiting agent.

4. The method according to claim 1, wherein the step of providing the lubricating layer comprises one of spraying or dipping in a liquid coating composition, followed by drying.

5. The method according to claim 1, wherein the second surface roughness is 2 μm or more.

6. The method according to claim 1, wherein the second surface roughness is in the range of from 2 μm to 6 μm.

7. The method according to 1, wherein the first surface roughness and the surface roughness of the expansion member are each less than or equal to 1 μm and greater than zero μm.

8. The method according to 1, wherein the step of treating a contact part of the inner surface to increase the surface roughness from a first surface roughness to a second surface roughness comprises blasting the contact part with particles.

9. The method according to claim 1, wherein the expansion member is cone-shaped.

10. The method according to any one of claims 1-7 and 8-9, wherein the expansion is expandable from a first cross-section to a second, larger, cross section.

11. The method according to claim 1, where in the expansion member has an engaging surface area, which engages, during the step of expanding the tubular member, the contact part of the inner surface of the tubular member, and wherein the engaging surface area has a surface roughness less than or equal to 0.5 μm and greater than zero μm.

12. An expandable tubular having a longitudinal passage and having an inner surface, wherein a contact part of the inner surface is treated such that an initial surface roughness of the contact part of the inner surface is increased to a second surface roughness between 1.5 μm and 10 μm, and wherein the contact part of the inner surface is covered by a lubricating coating, which is configured to be in a viscoelastoplastic phase at temperatures in a range between 50° C. and 110° C., wherein the second surface roughness is reduced to a third surface roughness during expanding of the longitudinal passage.

13. The expandable tubular according to claim 12 wherein the contact part of the inner surface has a surface roughness is in the range of from 2 μm to 6 μm.

14. The expandable tubular according to claim 12, wherein the expandable tubular is one of a length of well casing, well lining, or well tubing.

* * * * *